US006412257B1

(12) United States Patent
Liu et al.

(10) Patent No.: US 6,412,257 B1
(45) Date of Patent: Jul. 2, 2002

(54) PORTABLE AND MANUAL BINDING DEVICE

(75) Inventors: Chin-Chang Liu, Taichung; Chi-Chan Su, Taipei, both of (TW)

(73) Assignees: Tekpak Corporation, Taichung; Transpak Equipment Corporation, Taipei, both of (TW)

( * ) Notice: Subject to any disclaimer, the term of this patent is extended or adjusted under 35 U.S.C. 154(b) by 113 days.

(21) Appl. No.: 09/649,870

(22) Filed: Aug. 28, 2000

(51) Int. Cl.[7] ..... B65B 13/30
(52) U.S. Cl. ..... 53/592; 100/29
(58) Field of Search ..... 53/590, 592; 100/29, 100/32, 33 PB; 140/93.2, 93 A; 156/579

(56) References Cited

U.S. PATENT DOCUMENTS 2,982,069 A * 5/1961 England ..... 100/2
3,944,460 A * 3/1976 Karr ..... 100/33 PB
4,820,363 A * 4/1989 Fischer ..... 100/33 PB
5,029,433 A * 7/1991 Werk ..... 100/29
5,058,365 A * 10/1991 Kagi ..... 100/33 PB
5,653,095 A * 8/1997 Stamm ..... 100/32
6,085,498 A * 7/2000 Hua ..... 140/93.4

FOREIGN PATENT DOCUMENTS

GB 2118265 * 10/1983

* cited by examiner

*Primary Examiner*—Rinaldi I. Rada
*Assistant Examiner*—Paul Durand
(74) *Attorney, Agent, or Firm*—Harrison & Egbert

(57) ABSTRACT

A manual binding device including a base on which a seat body is mounted. The seat body is provided with a hand lever, a lift lever, and a slot in which a press lever member is pivoted for actuating a press block located in the interior of the seat body. The press member is formed of an eccentric cam rod, an arresting rod, and a press member. The eccentric cam rod and the arresting rod are connected by the press member. The press member is provided with a spring to alleviate the pressure exerted on a sealing pad and a binding strap at such time when the arresting rod is excessively exerted on by an external force.

1 Claim, 8 Drawing Sheets

PORTABLE AND MANUAL BINDING DEVICE

BACKGROUND OF THE INVENTION

1. Field of the Invention

The present invention relates generally to a binding device, and more particularly to a manually-operated binding device.

2. Description of Related Art

As shown in FIGS. 1–3, a binding device 10 of the prior art comprises a binding strap 1, a metal sealing pad 3, a press lever 4, an eccentric cam 5, a press block 6, and a base plate 7. The binding strap 1 is provided with an overlapped portion 2.

The prior art binding device 10 is defective in design because the press lever 4 must be exerted on by a force of an appropriate magnitude, so as to enable the metal sealing pad 3 to be pressed properly by the press block 6. In other words, if the press lever 4 is exerted on by an excessive force, the binding strap 1 is apt to be deformed or even damaged by the metal sealing pad 3. In addition, when the press lever 4 is exerted on by an excessive external force, the component parts of the prior art binding device 10 are under stress which undermine the operational precision and the service longevity of the prior art binding device 10.

BRIEF SUMMARY OF THE INVENTION

The primary objective of the present invention is to provide a manual binding device free from the drawbacks of the binding device of the prior art described above.

The binding device of the present invention comprises a press lever member which is constructed so as to prevent the binding strap from being deformed or severed by the metal sealing pad of the binding device.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
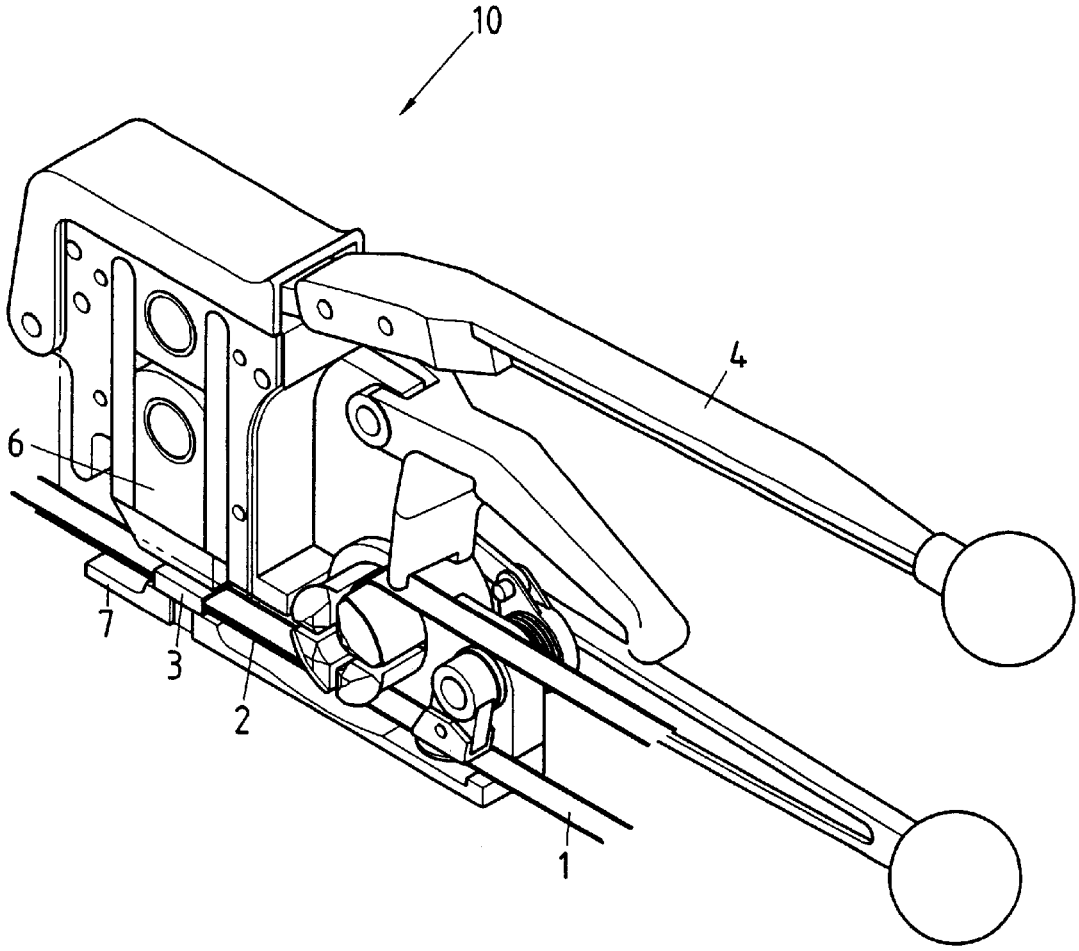
FIG.1 PRIOR ART
FIG. 1 shows a perspective view of a manual binding device of the prior art.
Figure 2:
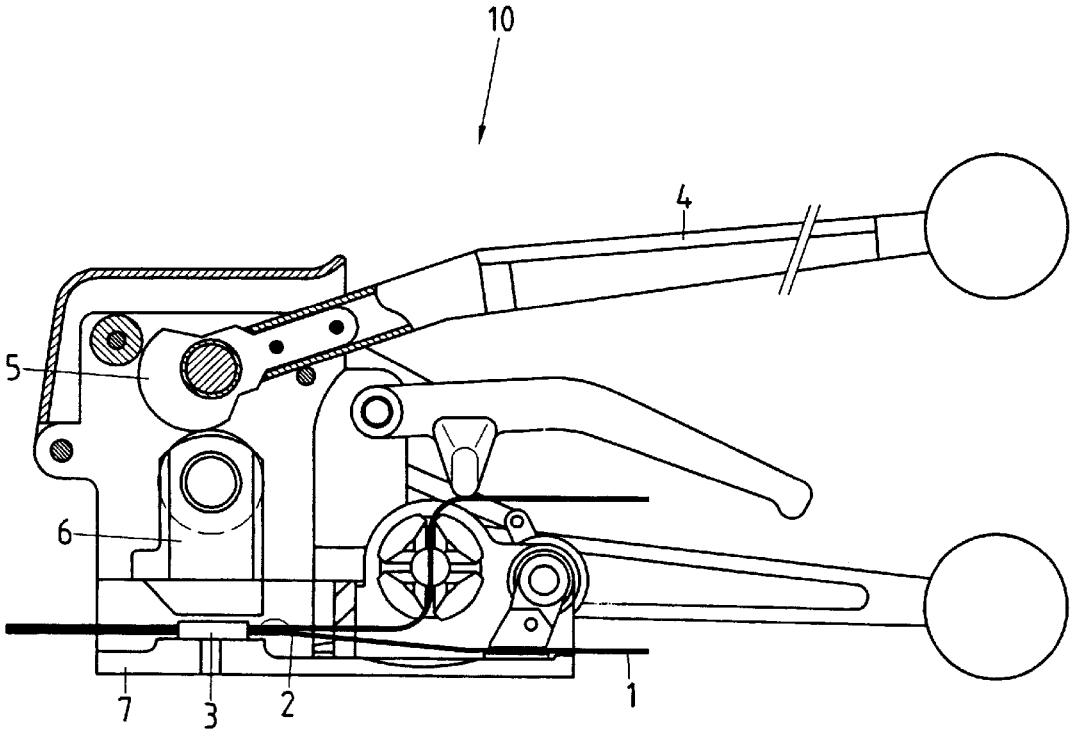
FIG.2 PRIOR ART
FIG. 2 shows a sectional view of the manual binding device of the prior art.
Figure 3:
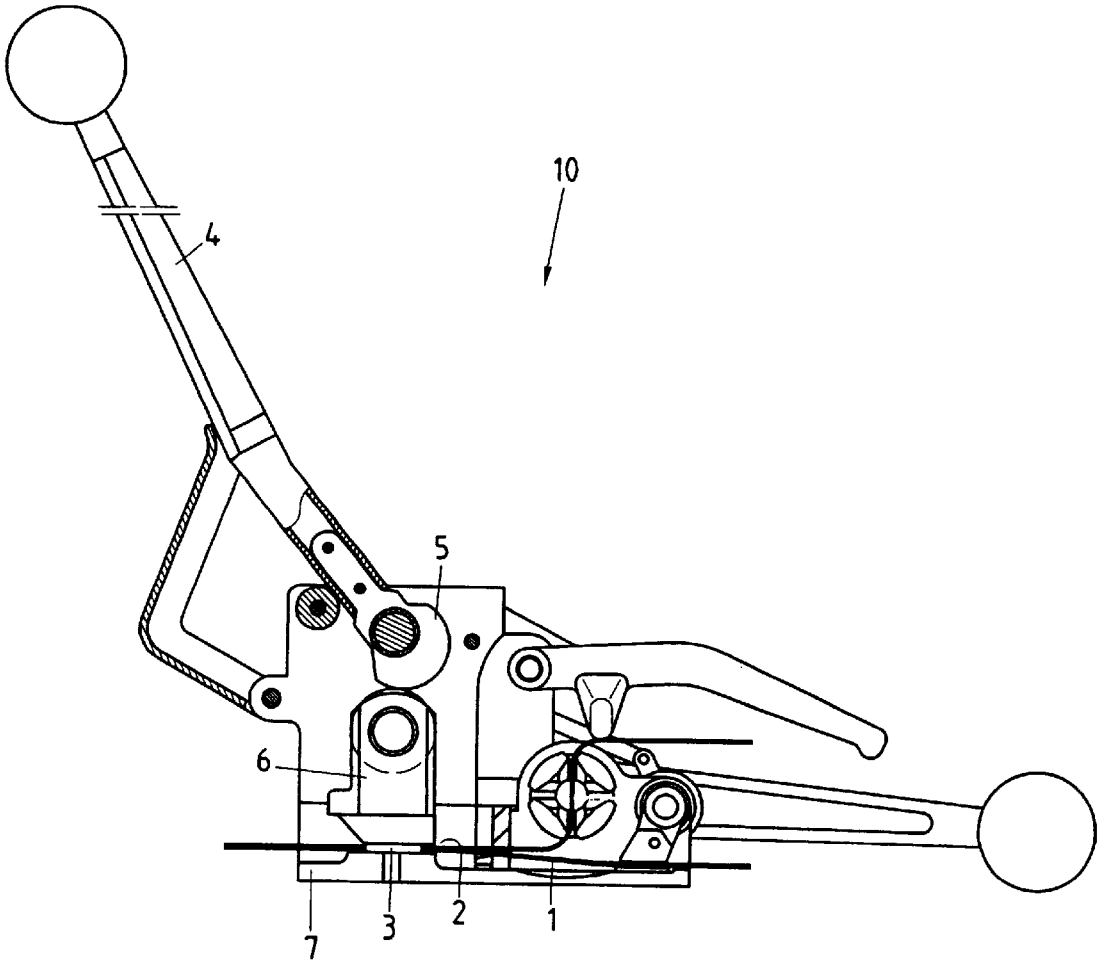
FIG.3 PRIOR ART
FIG. 3 shows another sectional view of the manual binding device of the prior art.
Figure 4:
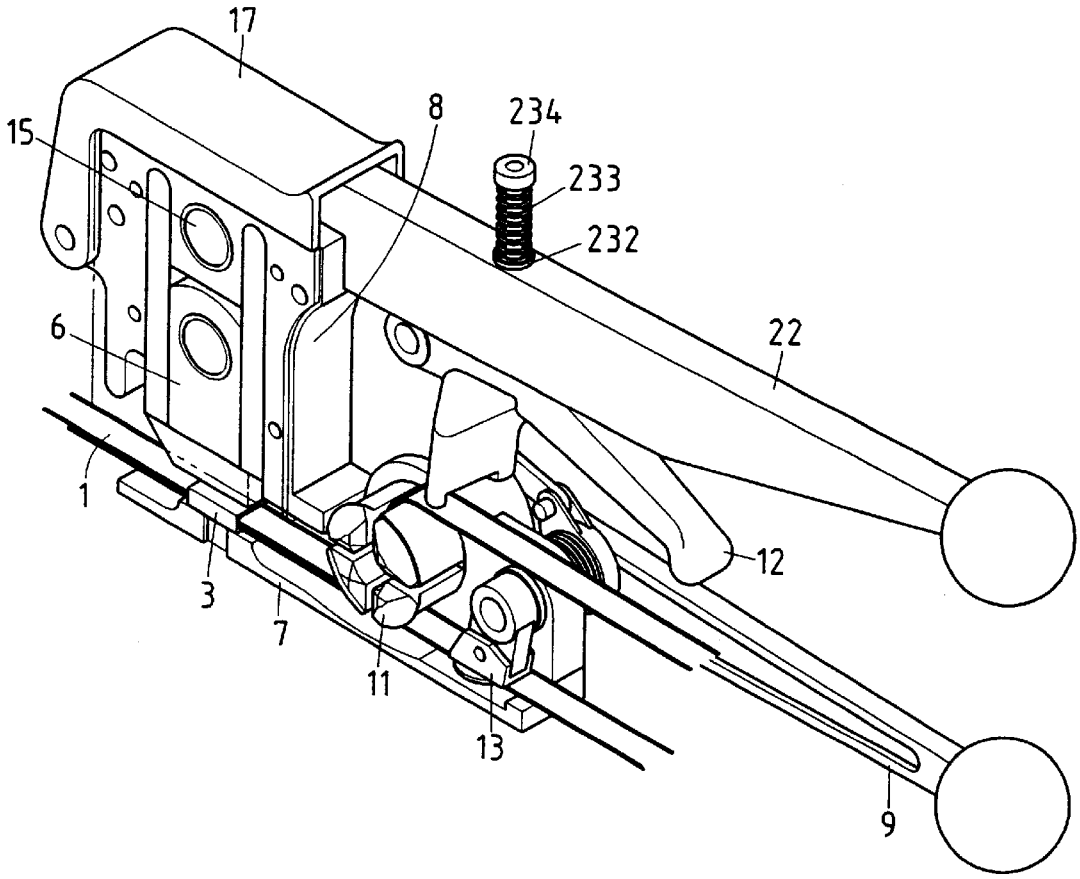
FIG. 4 shows a prospective view of a manual binding device of the present invention.
Figure 5:
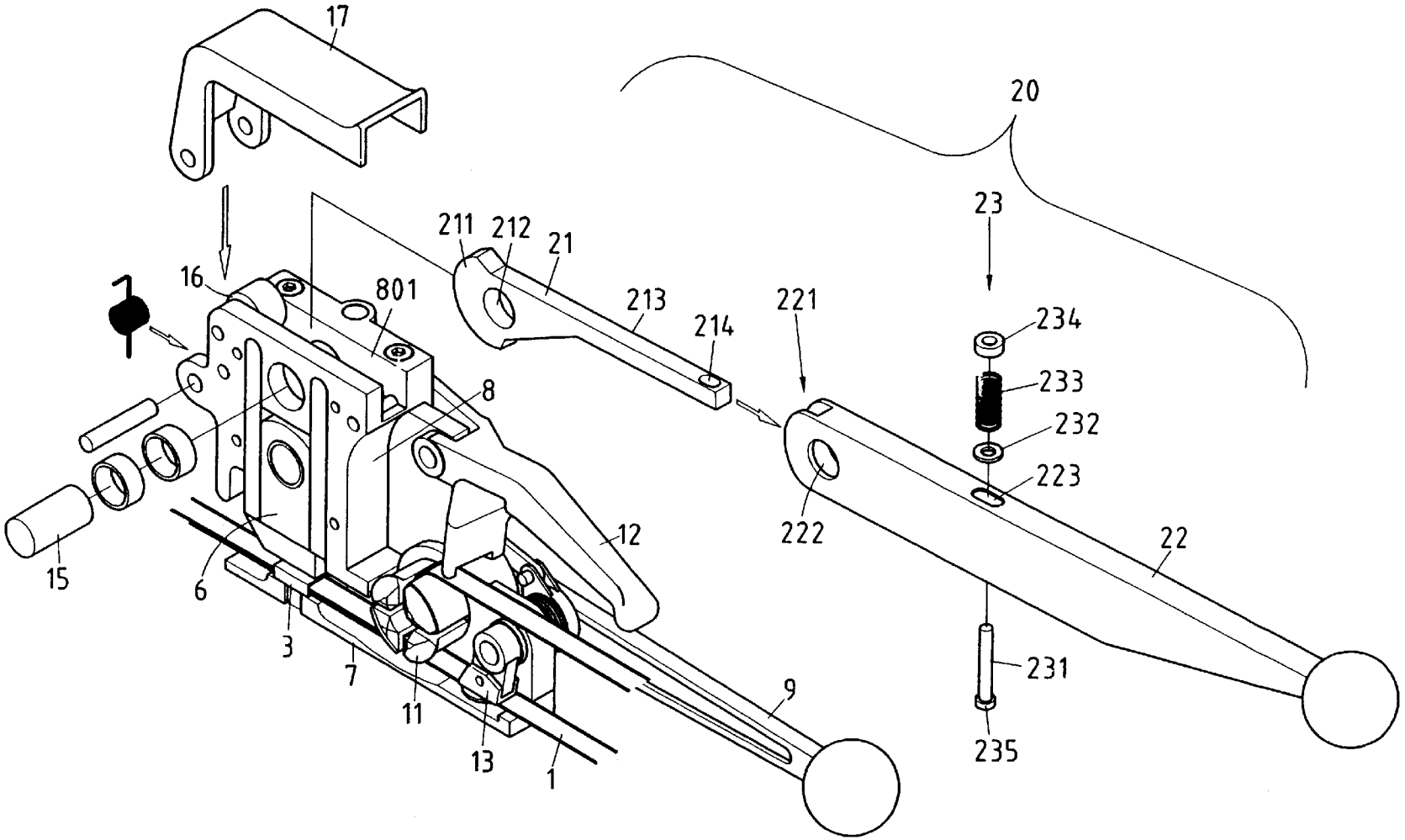
FIG. 5 shows an exploded view of the manual binding device of the present invention.

As shown in FIGS. 4–8, a manual binding device of the preferred embodiment of the present invention comprises a base 7 on which a seat body 8 is mounted. The seat body 8 is provided with a hand lever 9 for controlling a ratchet wheel 11, a lift lever 12 for controlling a press block 13, and a cutter 14. The seat body 8 is provided with a slot 801 in which a press lever member 20 is pivoted by a pivot 15 for actuating a press block 13 located in the interior of the seat body 8. The seat body 8 is further provided with a stop rod 16 for stopping the press lever member 20 from swinging. The seat body 8 is covered by a cover plate 17.

The present invention is characterized by the press lever member 20, which comprises an eccentric cam rod 21, an arresting rod 22, and a press member 23.

The eccentric cam rod 21 is provided with a cam 211 having an eccentric hole 212 and a connection rod 213 extending from the cam 211. The connection rod 213 is provided at the free end with a through hole 214.

The arresting rod 22 is of a hollow construction and is provided at one end with an opening 221 for receiving the cam rod 21, and a first through hole 222 corresponding in location to the eccentric hole 212. The arresting rod 22 is further provided with a second through hole 223 corresponding in location to the through hole 214 of the connection rod 213.

The press member 23 is formed of a locating bolt 231, a pad 232, a spring 233, and a fastening ring 234. The locating bolt 231 has an enlarged end 235. The locating bolt 231 juts out of the second through hole 223 of the arresting rod 22 via the through hole 214 of the connection rod 213 of the eccentric cam rod 21. The pad 232 and the spring 233 are fitted over the locating bolt 231 such that the spring 233 is disposed between the fastening ring 234 and the pad 232. The eccentric cam rod 21 and the arresting rod 22 are connected by the press member 23 such that the cam 211 is received in the slot 801 of the seat body 8, and such that the eccentric cam rod 21 and the arresting rod 22 are mounted on the pivot 15 which is put through the through hole 222 of the arresting rod 22 and the eccentric hole 212 of the cam 211 of the eccentric cam rod 21.

Figure 6:
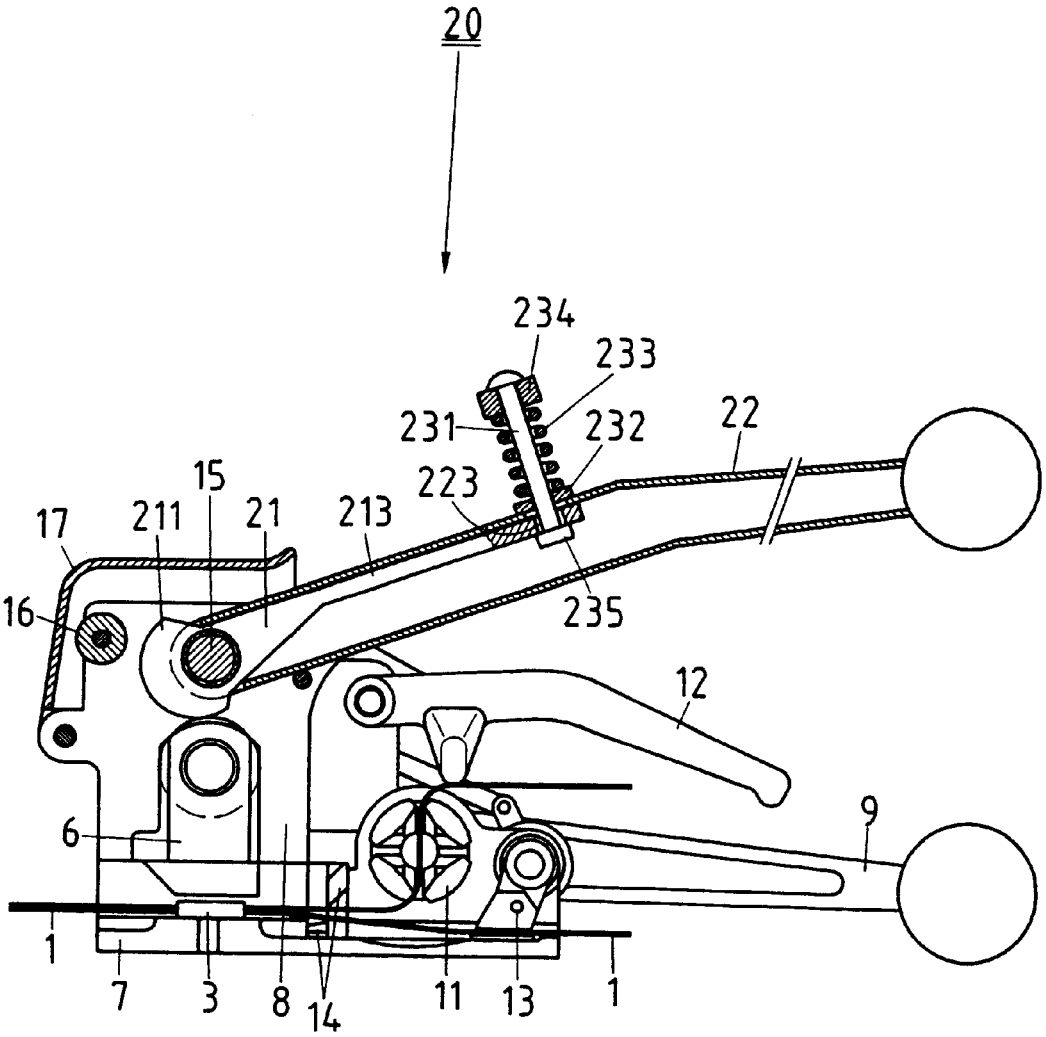
FIG. 6 shows a sectional view of the manual binding device of the present invention.
Figure 7:
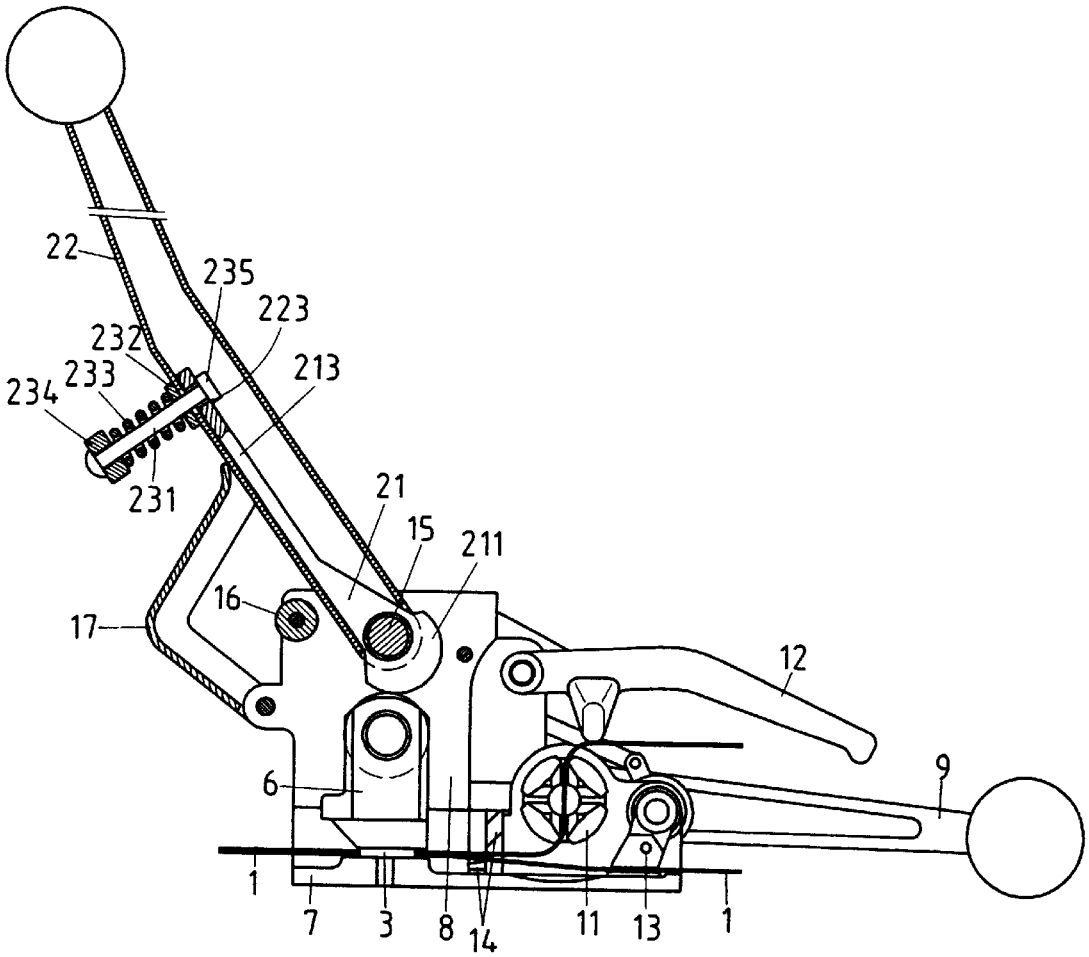
FIG. 7 shows a schematic view of the manual binding device of the present invention in operation.
Figure 8:
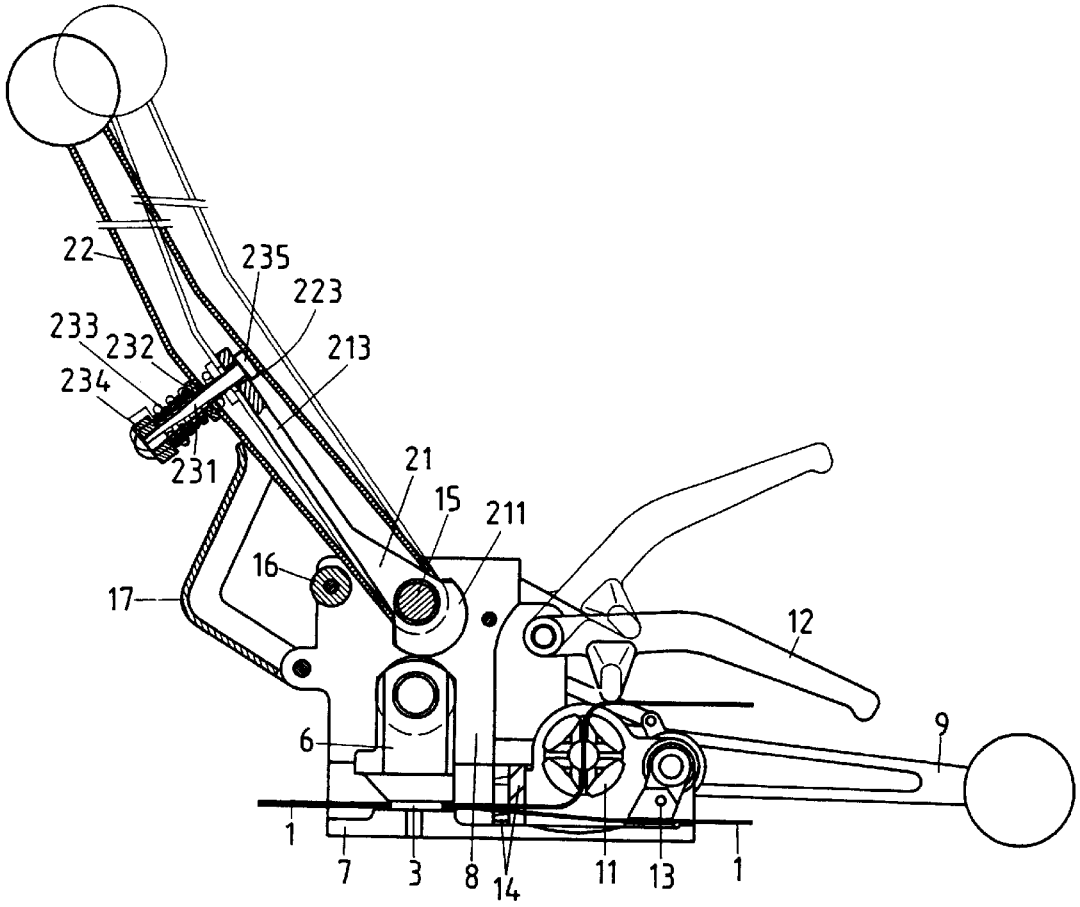
FIG. 8 shows another schematic view of the manual binding device of the present invention in operation.

As illustrated in FIGS. 6–8, when the arresting rod 22 is swiveled upwards, the cam 211 is actuated to turn such that the press block 6 is pushed by the cam 211 in motion to press the sealing pad 3 which in turn compresses the overlapped portion 2 of the binding strap 1. In the event that the arresting rod 22 is exerted on by an excessive external force, the spring 233 is compressed to prevent the eccentric cam rod 21 from turning continually. In the meantime, the reaction force of the arresting rod 22 acts on the hand of an operator to remind the operator of the completion of the binding operation. As a result, the metal sealing pad 3 and the binding strap 1 are prevented from being excessively pressed against.

We claim:

1. A manual binding device comprising a base on which a seat body is mounted, said seat body provided with a hand lever for controlling a ratchet wheel, a lift lever for controlling a press block, and a slot in which a press lever member is pivoted by a pivot for actuating a press block located in the interior of said seat body, said seat body further provided with a stop rod for stopping said press lever member from swinging; wherein said press lever member comprises:

an eccentric cam rod provided with a cam having an eccentric hole and a connection rod extending from said cam, said connection rod provided with a through hole;

an arresting rod of a hollow construction and provided at one end with an opening and a first through hole, said arresting rod further provided with a second through hole, said eccentric cam rod being fitted into said arresting rod via said opening of said arresting rod such that said first through hole of said arresting rod corresponds in location to said eccentric hole of said cam of said eccentric cam rod, and that said second through hole of said arresting rod corresponds in location to said through hole of said connection rod of said cam; and a press member formed of a locating bolt, a pad, a spring, and a fastening ring, said pad and said spring being fitted over said locating bolt which is juts out of said second through hole of said arresting rod via said through hole of said connection rod of said eccentric cam rod, said spring being located between said fastening ring and said pad, said eccentric cam rod and said arresting rod being connected by said press member such that said cam is disposed in said slot of said seat body, and that said eccentric cam rod and said arresting rod are pivoted by the pivot which is received in said first through hole of said arresting rod and said eccentric hole of said cam of said eccentric cam rod.

* * * * *